US005120263A

United States Patent [19]

Ierfino et al.

[11] Patent Number: 5,120,263

[45] Date of Patent: Jun. 9, 1992

[54] EXPLODING BOX

[76] Inventors: Don Ierfino, 7 Azrock Road, Toronto, Ontario, M6L 2W8; Vincenzo Leonetti, 73 Bun Avenue, North York, Ontario, M6L 1V3, both of Canada

[21] Appl. No.: 695,056

[22] Filed: May 3, 1991

[30] Foreign Application Priority Data

Mar. 4, 1991 [CA] Canada ..... 2037476

[51] Int. Cl.[5] ..... A63H 33/00

[52] U.S. Cl. ..... 446/486; 273/459; 446/310; 472/54

[58] Field of Search ..... 446/310, 486; 272/27 N, 272/27 R; 273/236, 285, 286, 450, 153 R, 459; 312/262, 289, 258; 40/124.1; 220/6

[56] References Cited

U.S. PATENT DOCUMENTS

| | | | |
|---|---|---|---|
| 162,141 | 4/1875 | Bayles | 273/450 |
| 578,445 | 3/1897 | Cobleigh | 312/262 X |
| 822,841 | 6/1906 | Hill | 272/27 R |
| 1,314,783 | 9/1919 | Bereznoy | 272/27 N |
| 2,692,455 | 10/1954 | Frampton | 272/27 N |
| 2,809,834 | 10/1957 | Frampton | 272/27 R |
| 3,056,602 | 10/1962 | Frampton | 272/27 N |
| 3,623,263 | 11/1971 | Frampton | 446/310 |
| 3,667,155 | 6/1972 | Freelander | 446/310 |
| 4,109,985 | 8/1978 | Lieb, Jr. . | |
| 4,407,504 | 10/1983 | Popov | 446/310 |
| 4,662,633 | 5/1987 | Zaruba et al. . | |
| 4,786,048 | 11/1988 | Lathti et al. | 272/27 N |
| 5,055,084 | 10/1991 | Jokic | 446/486 |

FOREIGN PATENT DOCUMENTS

| | | | |
|---|---|---|---|
| 1500257 | 11/1967 | France | 273/288 X |
| 2012601A | 1/1979 | United Kingdom . | |

*Primary Examiner*—William H. Grieb
*Assistant Examiner*—Sebastiano Passaniti
*Attorney, Agent, or Firm*—Moss, Barrigar & Oyen

[57] ABSTRACT

An exploding box is disclosed having upright sides which are provided with horizontal ribs or grooves which lock a false box bottom in position while the sides are maintained in an upright position by a top cover or lid. The false bottom is biased upwards by a compressed spring. When the top cover is removed, the upright sides of the box fold outwards, releasing the false bottom. The false bottom then springs upwards, springing forth any contents in the box.

12 Claims, 4 Drawing Sheets

EXPLODING BOX

BACKGROUND OF THE INVENTION

This invention relates to exploding boxes, and more particularly to exploding boxes which are used to startle unsuspecting persons who open such boxes.

Exploding boxes or tubes have been produced in the past for the purpose of startling or surprising the user. For example, a simple jack-in-the-box is a form of exploding box, where a crank mechanism releases a lid allowing a spring- loaded puppet surprisingly to emerge from the box. A difficulty with the common jack-in-the-box, however, is that the crank mechanism makes the nature of the box recognizable and gives away much of the surprise.

Another type of exploding box is a cylindrical tube with a screwed on lid having an expandable, spring-loaded, cylindrical member located inside. When the lid is screwed off, the spring-loaded inner member jumps out surprising the person removing the lid. A difficulty with this type of device is that it is so well known that it is very difficult to startle anyone who is handed the device to open.

There are other types of devices available that spring open to surprise or startle the user. One example of such devices is shown in J. V. Zaruba U.S. Pat. No. 4,662,633 issued for an exploding box which is decorated to resemble a washing machine. When articles are forced into the box from the top, they push downwards against a bottom. When the bottom is pushed down sufficiently, hinged sides of the box are concurrently lowered relative to a downturned flange on the top of the box which holds them in an upright position. When the sides are sufficiently lowered, they are released from the flange on the top of the box. The sides spring outwards spewing out the contents of the box.

Another such device is shown in U.K. patent No. 2,012,601 issued to A. E. Goldfarb et al which shows a game having a pyramid which has hinged sides that are held in an upright position by a top. The sides are pivotally attached to the bottom of the pyramid. A balloon located within the pyramid is inflated by a pump. At a threshold pressure the top lifts off and the sides of the pyramid spring outward. The top then falls. The motion is limited to the pivotal outward swing of the sides and the toppling of the top.

The problem with the prior art devices shown in Zaruba and Goldfarb is that the sudden movement is too limited to startle most unsuspecting users.

SUMMARY OF THE INVENTION

The present invention is a box with hinged sides and a spring-loaded false bottom that urges the sides to open. A removable lid holds the sides together. Upon removal of the lid, the sides pop open and the false bottom springs up ejecting any contents of the box.

BRIEF DESCRIPTION OF THE DRAWINGS

Preferred embodiments of the invention will now be described, by way of example, with reference to the accompanying drawings, in which.

DETAILED DESCRIPTION OF THE PREFERRED EMBODIMENTS

Figure 1:
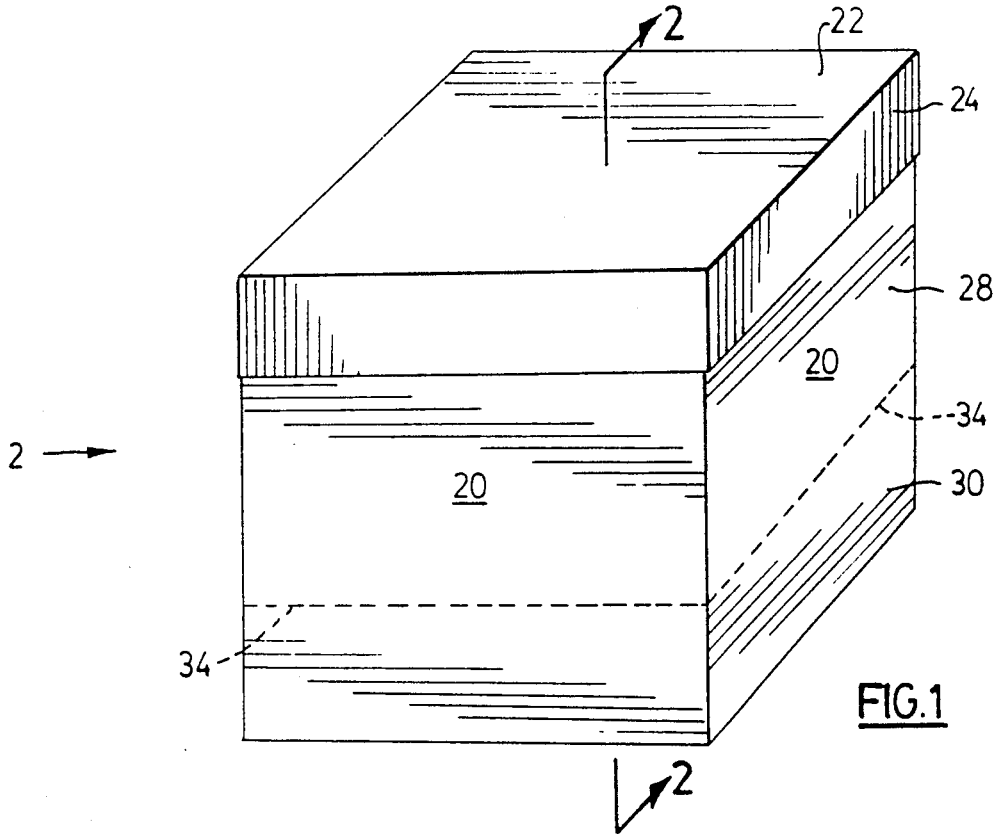
FIG. 1 is a perspective view of a closed box.
Figure 2:
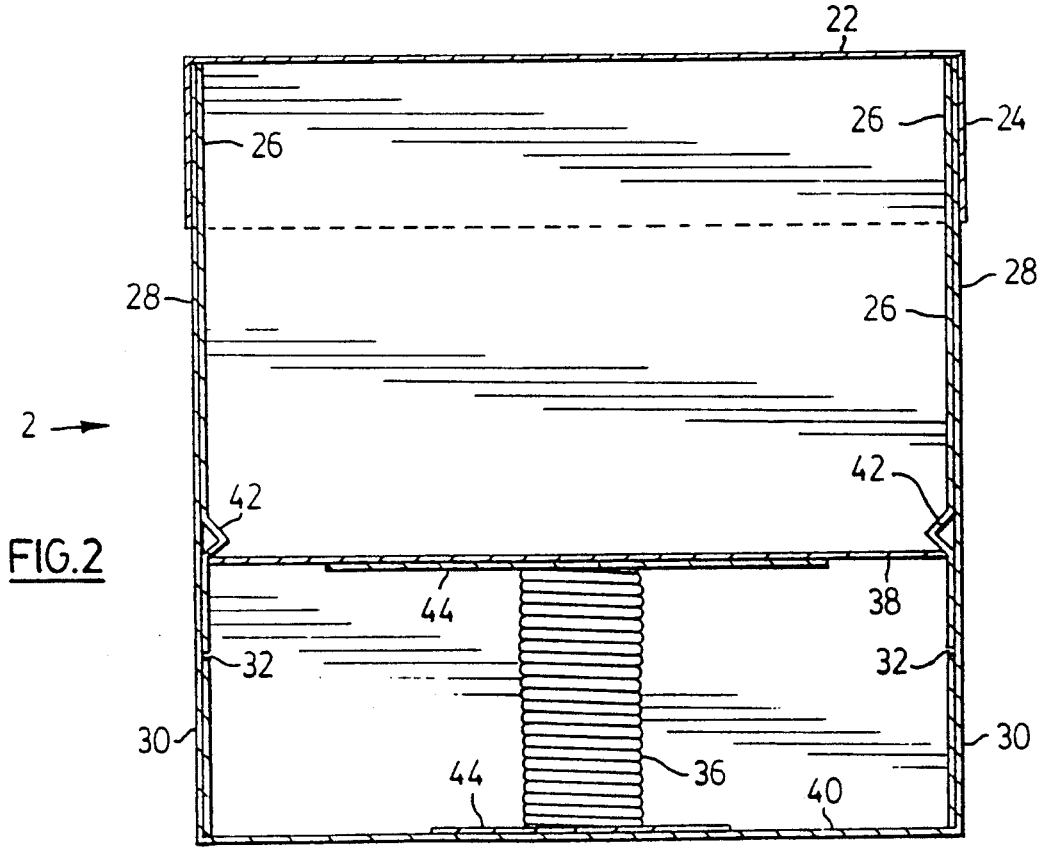
FIG. 2 is a cross-sectional view of the closed box taken along lines 2—2 of FIG. 1.

Referring to FIGS. 1 and 2, an exploding box 2 is shown in a closed position in FIG. 1. The box has sides 20, and a removable lid 22. FIG. 2 is a cross-sectional view of the box taken along lines 2—2 of FIG. 1. Sides 20 have upper end portions 26, intermediate sidewall portions 28 and lower end portions 30. A hinge 32 is located between each lower end portion 30 and the intermediate sidewall portion 28. Hinge 32 is represented by a dashed fold line 34 in FIG. 1 and indicates where the sides fold outwardly. It was found to be desirable to situate the hinge 32 on the sides 20 of the box about $\frac{1}{2}$ to $1\frac{1}{2}$ inches, or most preferably $\frac{3}{4}$ inch, above a bottom member 40. This arrangement facilitates the release of the sides 20 and a false bottom 38 when the box is grasped by the lower end portions 30. The lid 22 has a downturned flange 24 which is adjacent to the outside of the upper end portions 26 of the sides 20 of the box. When the lid 22 is on the box 2 as seen in FIG. 1, the downturned flange 24 on the lid 22 prevents the sides 20 from hingeably folding outwardly along fold lines 34.

A compressed spring 36 is disposed between false bottom 38 and bottom member 40. The bottom member 40 is affixed to the lower end portions 30 of sides 20 of the box 2. The spring 36 pushes upwardly against false bottom 38. The false bottom 38 is held down by abutments 42 which project inwardly from the intermediate sidewalls 28 of the box. Reinforcement plates 44 affix the ends of the spring to the false bottom 38 and the bottom member 40.

Figure 3:
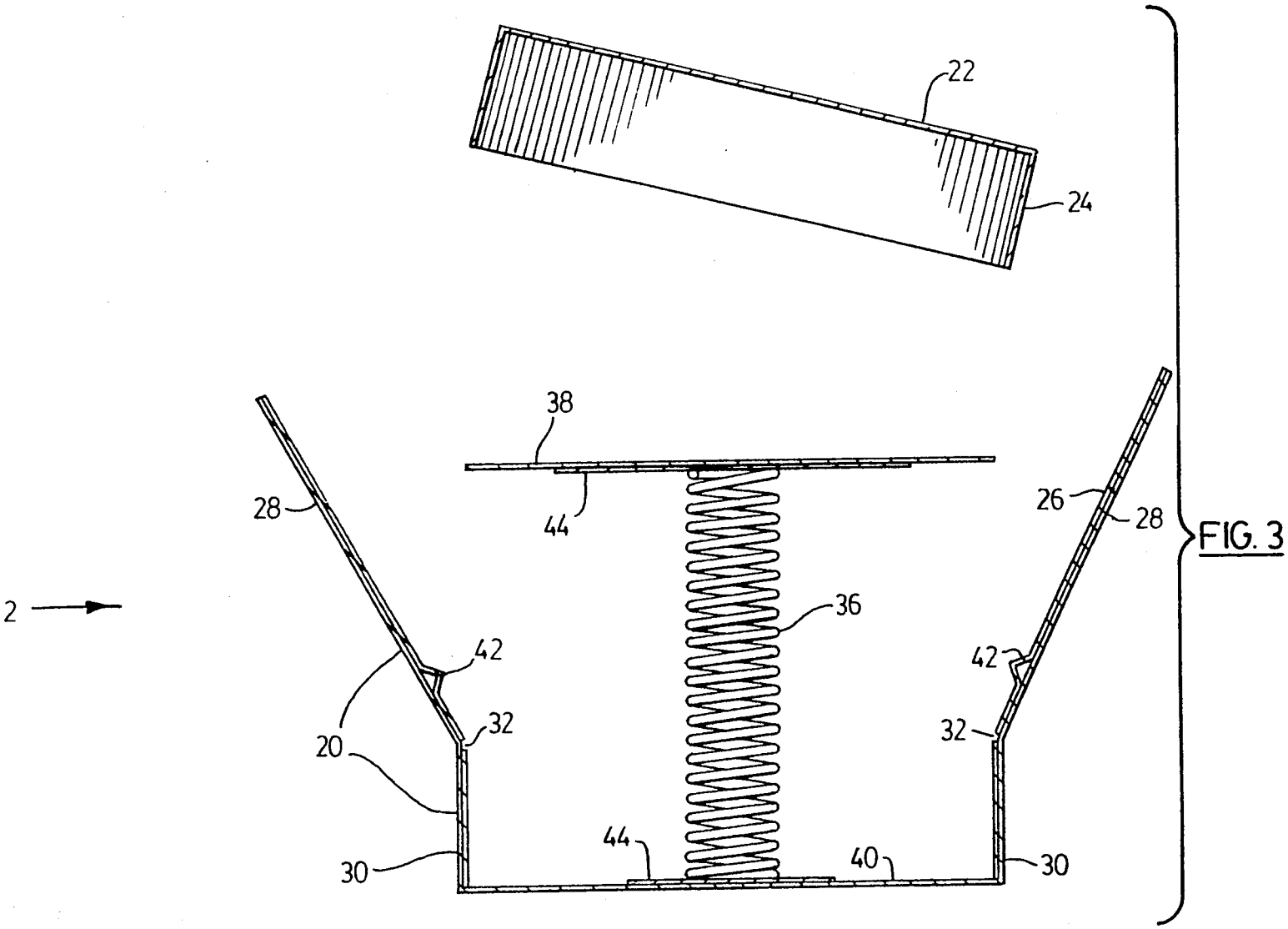
FIG. 3 is a cross-sectional view similar to FIG. 2 but showing the box in a partially open position.

FIG. 3 is a cross-sectional view of the box with the lid 22 removed. When the lid 22 is removed the false bottom 38 pushing upwardly forces the sides 20 to fold outwardly at the hinges 32, disposed between the lower end portions 30 and the intermediate sidewalls 28. After the sides have folded outwardly the abutments 42 no longer hold the false bottom 38 down against the force of the spring 36. The spring 36 then expands lifting the false bottom 38.

Figure 4:
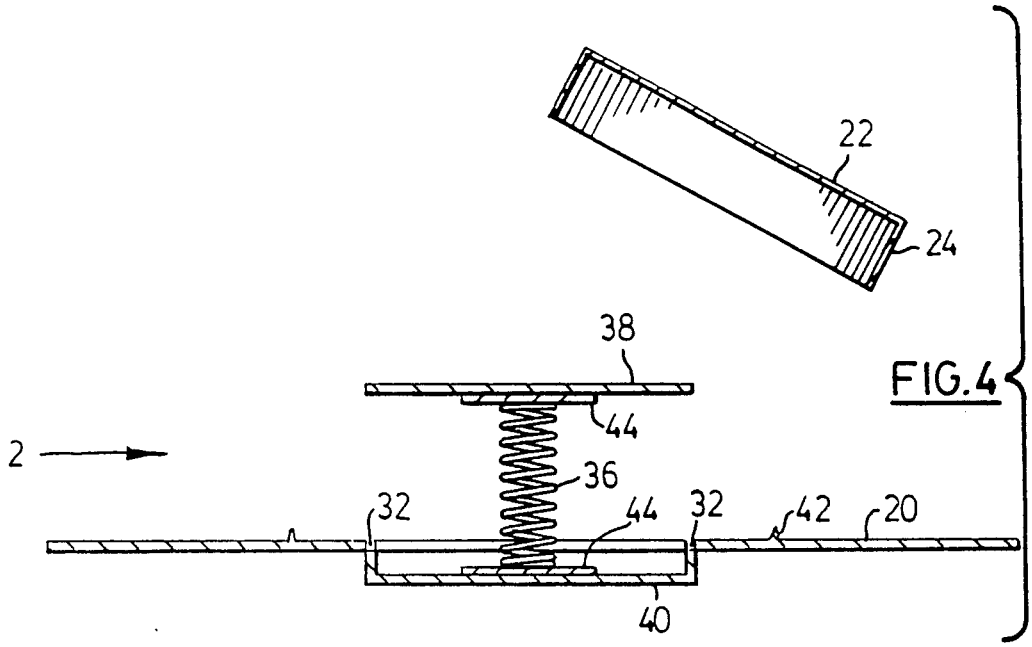
FIG. 4 is a sectional view similar to FIG. 3 but showing the box in a fully open position.

FIG. 4 shows the box 2 in a fully open position.

Figure 5:
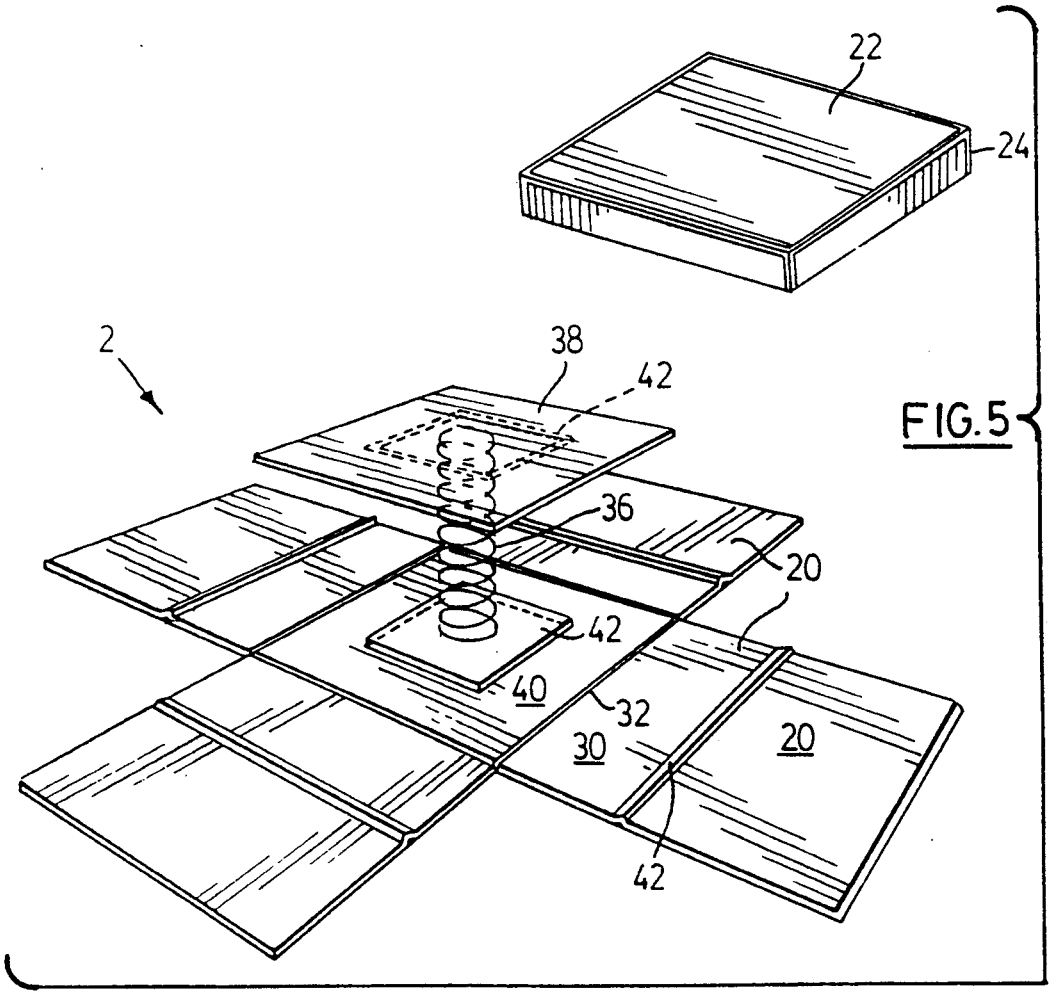
FIG. 5 is a perspective view of an alternative embodiment of a box in an open position.

FIG. 5 is a perspective view of an embodiment of the box having the hinge 32 disposed between the lower end portions 30 and the bottom member 40 of the box 2.

Figure 6:
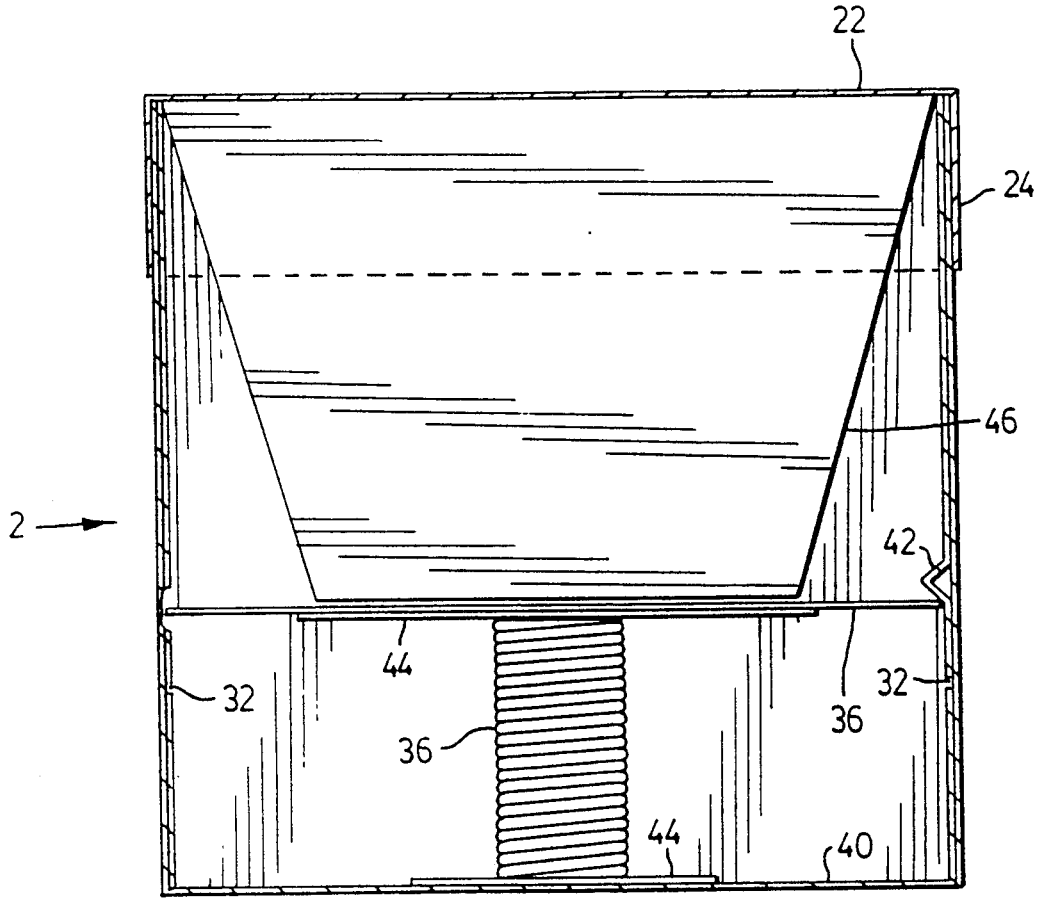
FIG. 6 is a cross-sectional view similar to FIG. 2 but showing some modifications to the preferred embodiment.

FIG. 6 is a cross-section of a box having a sign such as a greeting card 46 affixed to the false bottom 38 of the box. The card 46 may be selected so as to have an appropriate greeting for the occasion e.g. Happy Birthday. The card will spring forth, opening when the lid of the box is removed. An abutment 42 is shown on one side 20 of the box 2 engaging the false bottom 38. An alternative latch means in the form of a horizontal groove 48 is shown on the other side of the box 2 engaging the false bottom 38.

Figure 7:
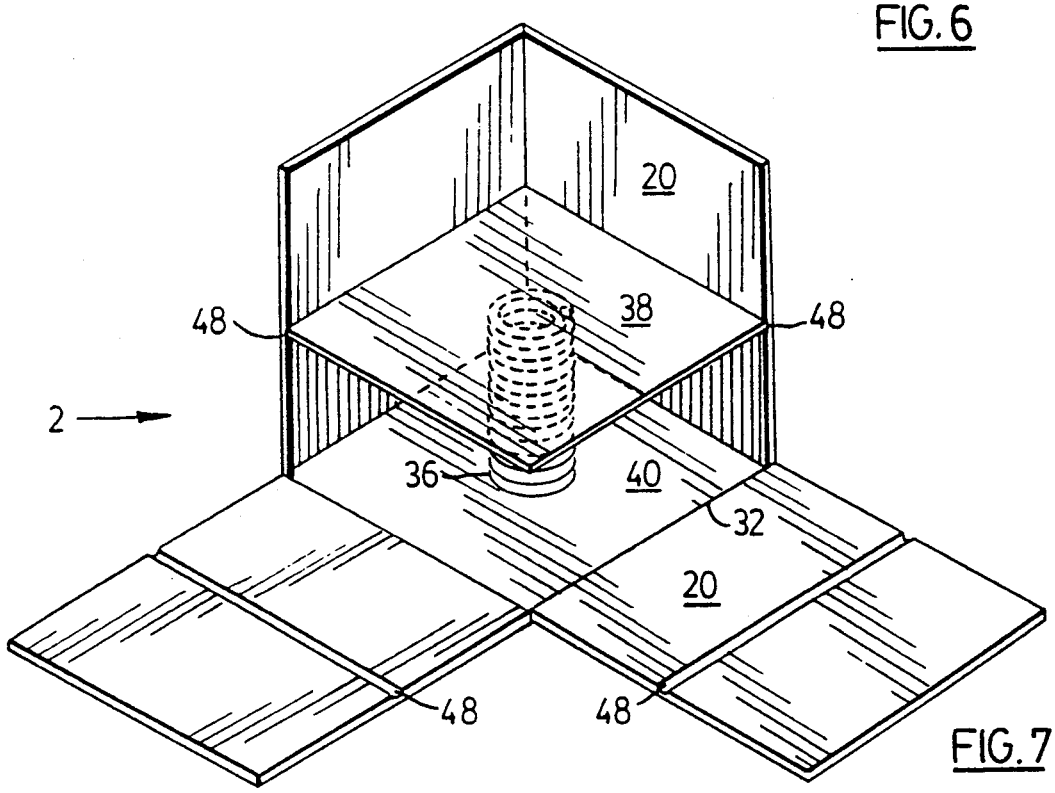
FIG. 7 is a perspective view of a partially opened box having grooved sides and its lid removed.

FIG. 7 is a perspective view of a box having groove 48 latch means. The grooves 48 are adapted to engage the false bottom 38 of the box The grooves 48 are shown on the upright sides of the box engaging the false bottom 38. The grooves 48 are most clearly shown on the open sides 20 of the box 2. A hinge 32 is shown between a side 20 of the box 2 and the bottom member 40.

In preferred embodiments, the exterior of the box 2 is decoratively printed or covered with decorative paper. The sides may be made of cardboard. Hinges 32 may be thinner paper or simply be decorative paper spanning between the cardboard bottom member 40 and sides 20 which fold outwards. Alternatively, box 2 may be made of a suitable plastic material, with hinges 32 being formed by reducing the wall thickness, or by any other suitable means.

Having described the drawings of the box, it can be appreciated that the exploding box will spring forth any contents which are placed on the false bottom 38 above the compressed spring. It is suggested that confetti, foam chips, or a greeting card secured to the false bottom 38 with an accordion type connector might be used in the box. The greeting or item to be sprung forth would be selected to suit the occasion and the recipient. A ribbon might be used to secure a small gift to the false bottom 38 of the box. For safety reasons, it is important not to place any hard items in the box which might injure a person opening the box.

It is suggested that the box might surprise the same recipient more than once if it were enclosed within a box containing a gift. In this case, the bottom of the exploding box would be affixed to the bottom of the gift box, and the cover of the exploding box would be affixed or tied to the cover of the gift box. This would result in the exploding box springing forth its contents when the recipient of the gift lifted its cover.

It will also be appreciated that any number of sides 20 may be employed, as long as there are at least two sides disposed in a manner such that false bottom 38 is held in position when said sides are retained in an upright configuration.

We claim:

1. An exploding box comprising:

a plurality of upright sides having upper end portions, lower end portions and intermediate sidewalls; a removable lid having a peripheral flange and being slidably mounted on the upper end portions of the upright sides to hold the intermediate sidewalls upright; a bottom member extending between said lower end portions, wherein said plurality of upright sides, said removable lid and said bottom member may be collectively assembled to define an enclosed chamber therebetween;

hinge means connected to the lower end portions of the sides to allow the sides to hingedly open outwardly when said lid is removed;

a false bottom located within said chamber and configured to abut said intermediate sidewalls;

latch means formed in the intermediate sidewalls to engage the false bottom to prevent upward movement of the false bottom when the sidewalls are upright; and bias means located within the chamber to urge the false bottom upwardly past the latch means when the intermediate sidewalls open outwardly.

2. A box as claimed in claim 1 wherein the bias means is a compressed spring disposed between the bottom member and the false bottom.

3. A box as claimed in claim 1 wherein the hinge means is flexible paper.

4. A box as claimed in claim 1 wherein the box is made of cardboard and covered with decorative paper.

5. A box as claimed in claim 1 and further comprising a greeting card mounted on the false bottom.

6. A box as claimed in claim 1 wherein the box has four sides comprising two pairs of opposite sides.

7. A box as claimed in claim 1 wherein the latch means is an inwardly projecting abutment on the intermediate sidewalls.

8. A box as claimed in claim 7 wherein the hinge means is between ½ and 1½ inches above the bottom member of the box.

9. A box as claimed in claim 7 wherein the hinge means is connected between the lower end portions and the bottom member.

10. A box as claimed in claim 1 wherein the latch means comprises a horizontal groove in the intermediate sidewalls adapted to receive the false bottom.

11. A box as claimed in claim 10 wherein the hinge means is between ½ and 1½ inches above the bottom member of the box.

12. A box as claimed in claim 10 wherein the hinge means is connected between the lower end portions and the bottom member.

* * * * *